US009525230B2

(12) United States Patent
Zhu et al.

(10) Patent No.: US 9,525,230 B2
(45) Date of Patent: Dec. 20, 2016

(54) CONNECTOR HAVING TERMINAL POSITION ASSURANCE ARTICLE

(71) Applicant: Tyco Electronics Technology (SIP) Co., Ltd., Jiangsu (CN)

(72) Inventors: Jianghua Zhu, Jiangsu (CN); Siqi Chen, Jiangsu (CN)

(73) Assignee: Tyco Electronics Technology (SIP) Co., Ltd., Suzhou (CN)

( * ) Notice: Subject to any disclaimer, the term of this patent is extended or adjusted under 35 U.S.C. 154(b) by 0 days.

(21) Appl. No.: 14/725,610

(22) Filed: May 29, 2015

(65) Prior Publication Data

US 2015/0349449 A1 Dec. 3, 2015

(30) Foreign Application Priority Data

May 29, 2014 (CN) ..... 2014 2 0283439 U

(51) Int. Cl.
*H01R 13/514* (2006.01)
*H01R 13/436* (2006.01)
*H01R 13/422* (2006.01)

(52) U.S. Cl.
CPC ..... *H01R 13/4368* (2013.01); *H01R 13/4223* (2013.01)

(58) Field of Classification Search
CPC ..... H01R 13/4392; H01R 13/4223; H01R 13/4226
USPC ..... 439/752, 595
See application file for complete search history.

(56) References Cited

U.S. PATENT DOCUMENTS 6,641,437 B2 * 11/2003 Tsuji ..... H01R 13/4223 439/595
6,764,352 B2 * 7/2004 Tsuji ..... H01R 13/4364 439/595
6,863,568 B2 * 3/2005 Nakamura ..... H01R 13/4364 439/595
7,097,503 B2 * 8/2006 Tsuji ..... H01R 13/4365 439/595
7,278,883 B2 * 10/2007 Tyler ..... H01R 13/4364 439/595
7,387,545 B2 * 6/2008 Tyler ..... H01R 13/4365 439/595
8,678,865 B2 * 3/2014 Hiraishi ..... H01R 13/4365 439/595
9,017,111 B2 * 4/2015 Zheng ..... H01R 13/4223 439/595

* cited by examiner

*Primary Examiner* — Hae Moon Hyeon
(74) *Attorney, Agent, or Firm* — Barley Snyder

(57) ABSTRACT

A connector is provided and includes a housing and a terminal position assurance article. The housing has a body and a terminal receiving portion extending rearward from the body. The terminal position assurance article is wholly received into a rear end of the housing and corresponds with the terminal receiving portion.

20 Claims, 7 Drawing Sheets

CONNECTOR HAVING TERMINAL POSITION ASSURANCE ARTICLE

CROSS-REFERENCE TO RELATED APPLICATIONS

This application claims the benefit of the filing date under 35 U.S.C. §119(a)-(d) of Chinese Patent Application No. 201420283439.5, filed May 29, 2014.

FIELD OF THE INVENTION

The present invention relates to a connector and, more particularly, to a connector having a housing and terminal position assurance article.

BACKGROUND

Known connectors and, in particular, vehicle connectors, perform a secondary locking function when a terminal position assurance article (a "TPA article") is inserted into a housing.

FIG. 1 and FIG. 2, respectively, show a structural schematic view of a known connector before and after assembly. Such known connectors generally include a housing 100' and a TPA article 200'. The housing 100' includes a body 101' and at least one terminal receiving inner passageway 102'. Each terminal receiving inner passageway 102' has a head portion 103' extending forward from a center of a front wall of the main body 101' and out of the main body 101', and a tail portion 104' extending rearward into the main body 101'. Each terminal receiving inner passageway 102' has a first horizontal elastic cantilever 105' formed by extending vertically upward from a front end of an inner bottom surface 108' and then extending backwardly horizontally. A locking slot 109' is formed between the first horizontal elastic cantilever 105' and the inner bottom surface 108'.

The TPA article 200' includes a locking plate 201' that can be inserted into the locking slot 109' and a front end of the locking plate 201' is directly lapped on the inner bottom surface 108' of the terminal receiving inner passageway 102'. Before assembly (when the TPA article is at a pre-locked position), the locking plate 201' is not inserted into the locking slot 109' and a rear end of the TPA article 200' is exposed out of the housing 100'. However, after assembly (when the TPA article is at a locked position), the locking plate 201' is inserted into the locking slot 109' and the TPA article 200' is entirely received in the housing 100'. Since the rear end of the TPA article 200' needs to be exposed out of the housing 100' before assembly, the locking plate 201' is easily pressed by an external force to cause a mistaken insertion into the locking slot 109' and thus causing a failure of the connector. Therefore, such connectors cannot be pressed against one another upon packaging and a tray is needed to be used to package the connectors before assembly such that the packaging cost is higher and a greater requirement is imposed for the packaging space.

SUMMARY

One objective of the present invention is to provide a connector which can overcome one or more of the above drawbacks of connectors in the prior art.

A connector is provided and includes a housing and a terminal position assurance article. The housing has a body and a terminal receiving portion extending rearward from the body. The terminal position assurance article is wholly received into a rear end of the housing and corresponds with the terminal receiving portion.

BRIEF DESCRIPTION OF THE DRAWINGS

The present invention will now be described by way of example with reference to the accompanying figures of which.

DETAILED DESCRIPTION OF THE EMBODIMENT(S)

Figure 1:
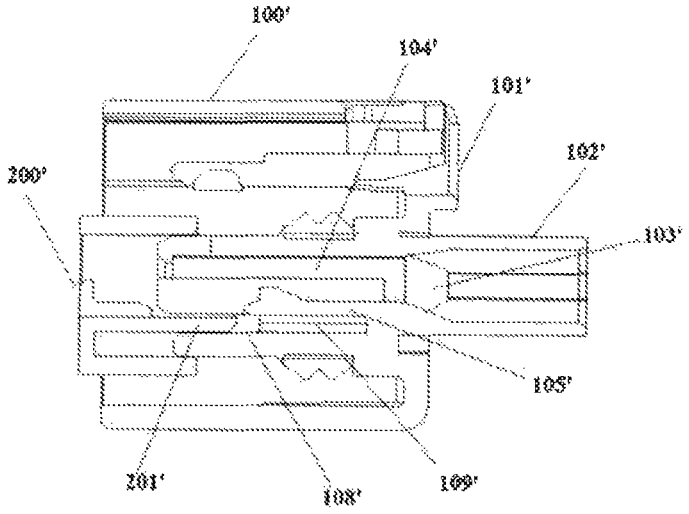
Fig. 1 (Prior Art)
FIG. 1 is a sectional view of a known connector before assembly.
Figure 2:
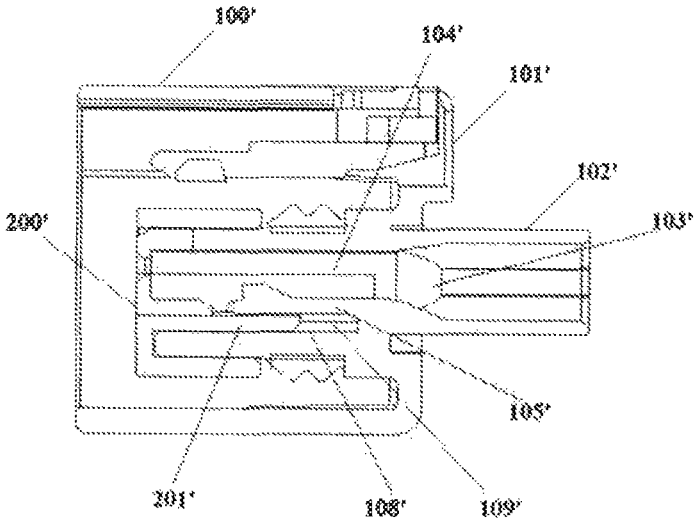
Fig. 2 (Prior Art)
FIG. 2 is a sectional view of another known connector being assembly.

The connector according to the present invention is described below in detail with reference to the figures. Those skilled in the art should appreciate that embodiments described below are only exemplary illustration of the present invention and not intended to limit the present invention. Like reference numbers in all figures denote like or similar parts.

With reference to FIGS. 3A-3C and FIGS. 4A-4B, a connector according to the present invention will be described. The connector includes a housing 100 and a terminal position assurance article (hereinafter referred to as "TPA article") 200. The housing 100 and TPA article 200 each may be integrally injection molded of any appropriate material, such as polybutylene terephthalate ("PBT"), by a molding process.

As shown in the figures, the housing 100 of the connector includes a body 101 and a terminal receiving portion 102. At least one terminal receiving inner passageway 103 for receiving a terminal is disposed in the terminal receiving portion 102. There are usually a plurality of terminal receiving inner passageways 103 which are adjacently disposed in parallel. In a specific embodiment of a vehicle connector, there are eight terminal receiving inner passageways 103 which are disposed in parallel. The TPA article 200 can be inserted into the housing 100 from a rear end of the housing 100 and cooperates with the terminal receiving portion 102 to form a pre-locked condition (before assembly) and a locked condition (after assembly).

The terminal receiving portion 102 has a tail portion 104 extending rearward from the body 101. A periphery of the tail portion 104 of the terminal receiving portion 102 forms a first housing section, and the TPA article 200 has a second housing section mating with the first housing section. The second housing section on the TPA article 200 may be disposed, in a form of a sleeve, on the first housing section of the tail portion 104 of the terminal receiving portion 102 to achieve connection of the body 101 and the TPA article 200.

Each terminal receiving inner passageway 103 of the terminal receiving portion 102 has a terminal blocking member 105 to prevent the terminal mounted in the terminal receiving inner passageway 103 from accidentally retreating therefrom. For example, the terminal blocking member 105 has a front inclined guide surface 106 and a rear perpendicular locking surface 107 which may cooperate with a respective retreat-stopping structure on the terminal. In the example shown in the figures, the first housing section has an inner bottom surface 108. The terminal blocking member 105 may be a first elastic cantilever structure formed by extending upward from a front end of the inner bottom surface 108 and then extending backward horizontally. The terminal blocking member 105 is spaced apart from the inner bottom surface 108 of the first housing section to form a locking slot 109. The locking slot 109 may be configured to receive a terminal lock 201 on the TPA article 200 at the locked position so as to prevent the terminal blocking member 105 in the housing 100 from being biased by a force and thus fixing the terminal within the connector.

Figure 4A:
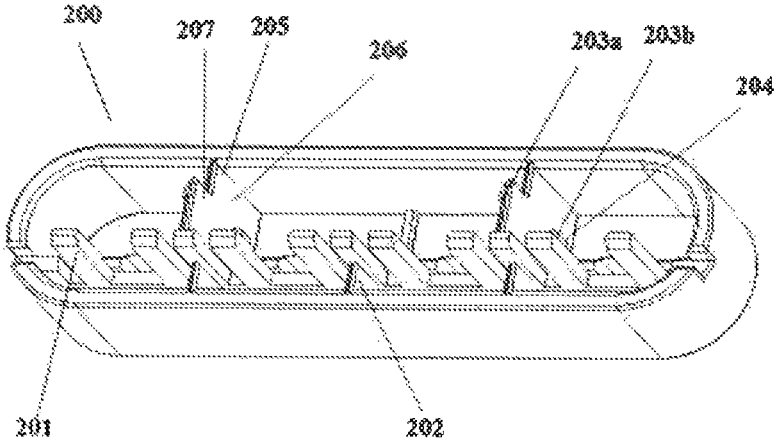
FIG. 4A is a perspective view of a TPA article of a connector according to the present invention.
Figure 4B:
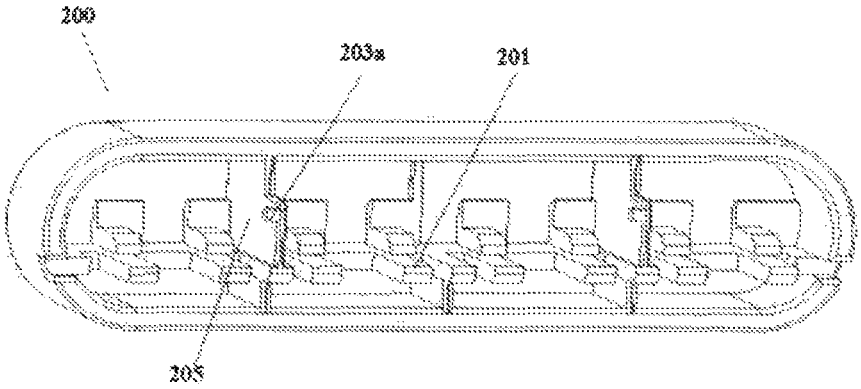
FIG. 4B is another perspective view of the TPA article shown in FIG. 4A.
Figure 7:
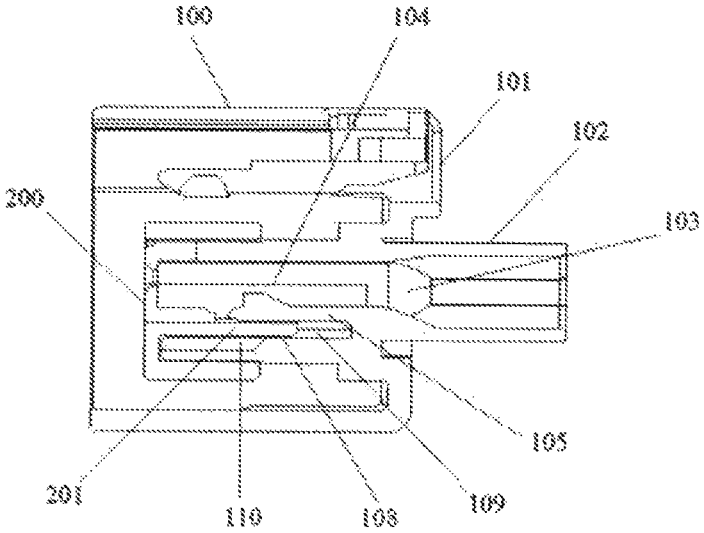
FIG. 7 is a sectional view of the connector according to the present invention after assembly.

Referring to FIGS. 4A-4B, the TPA article 200 of the connector according to the present invention has the terminal lock 201. With reference to FIG. 7, when in the locked position after assembly of the connector, the terminal lock 201 may extend into the locking slot 109 in the housing 100 and is located between the terminal blocking member 105 and the inner bottom surface 108 of the first housing section to prevent the terminal blocking member 105 from being biased by a force in use so that the terminal mounted in the terminal receiving inner passageway 103 accidentally retreats therefrom. In the example shown in the figures, the terminal lock 201 extends forward horizontally from above the inner bottom surface of the second housing section. Preferably, the terminal lock 201 forms a plurality of second elastic cantilever structures corresponding to each terminal blocking member 105 and the plurality of second elastic cantilever structures are spaced apart from each other to form a comb-shaped terminal lock 201 (as shown in FIG. 4A and FIG. 4B). When the terminal is inserted at the pre-locked position, the comb-shaped terminal lock 201 helps the terminal blocking member 105 and the corresponding portion of terminal lock 201 to be biased and deform at the same time so that the terminal is inserted into the terminal receiving inner passageway 103.

Figure 3A:
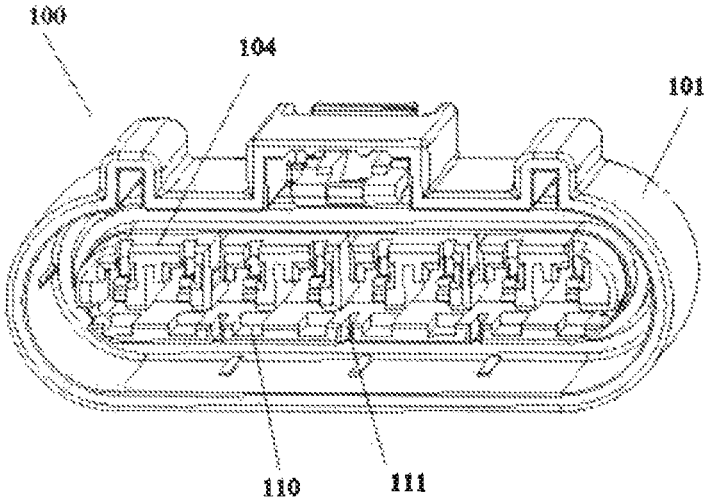
FIG. 3A is a perspective view of a connector housing according to the present invention.
Figure 3B:
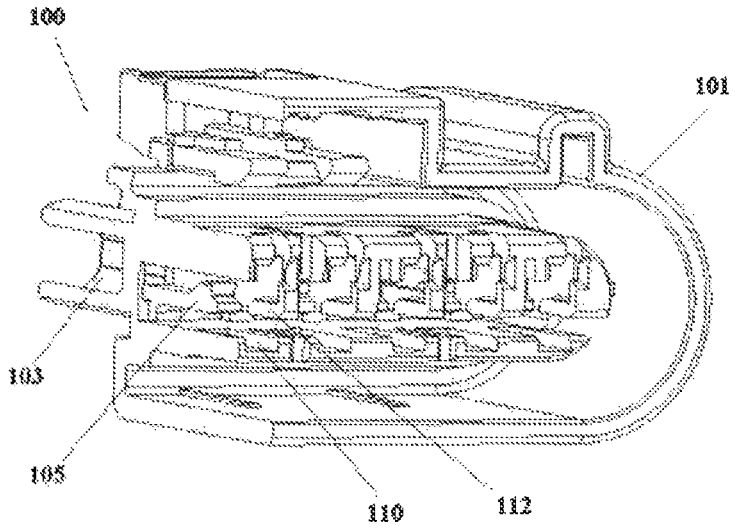
FIG. 3B is a perspective sectional view of the connector housing shown in FIG. 3A.
Figure 3C:
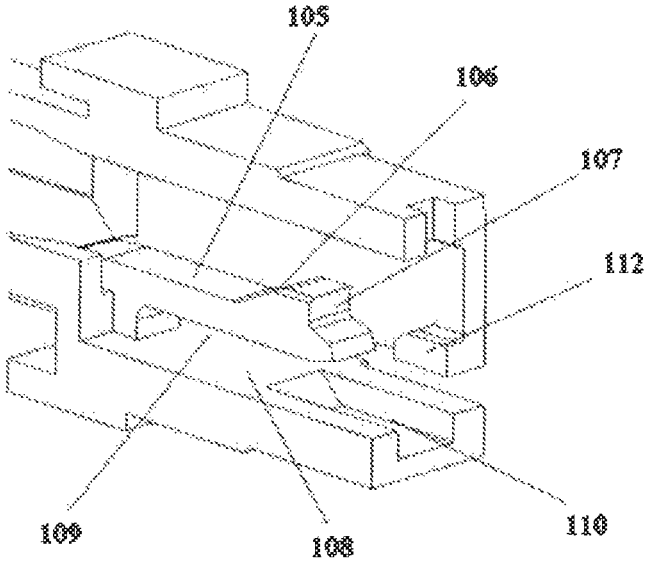
FIG. 3C is a partially enlarged view of a portion of the connector housing shown in FIG. 3B.
Figure 5:
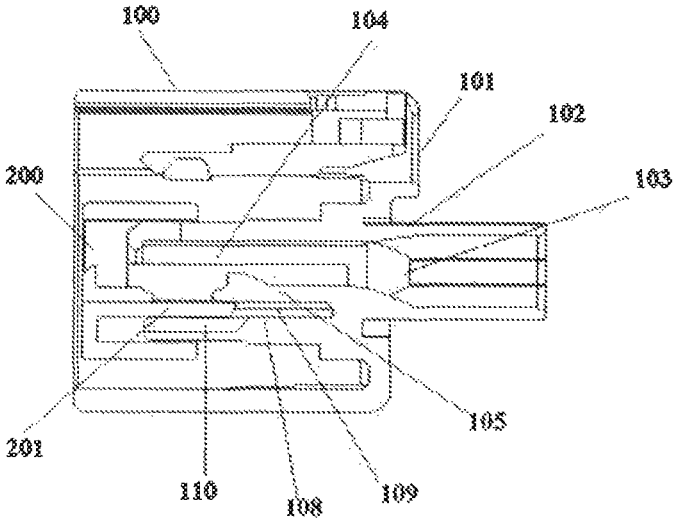
FIG. 5 is a sectional view of a connector according to the present invention before assembly.
Figure 6:
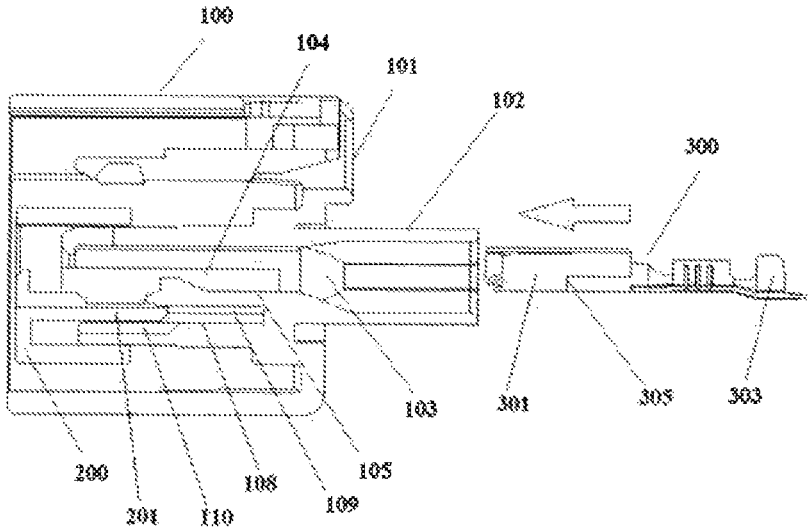
FIG. 6 is a sectional view of the connector according to the present invention showing assembly with a terminal.

As shown in FIGS. 3A-3C, in the terminal receiving inner passageway 103 of the housing 100, a rearward extension length of the inner bottom surface 108 of the first housing section is less than a rearward extension length of the terminal blocking member 105 (see FIGS. 5, 6, and 7). For example, a rear end of a lower housing of the first housing section has a notch or groove 110 below the corresponding terminal receiving inner passageway 103. As shown in FIGS. 5 and 6, the notch or groove 110 extends continuously from the rear end of the lower housing of the first housing section and a front end of the notch or groove 110 is located below the rear end of the terminal blocking member 105. When the TPA article 200 is at the pre-locked position, a front end of the terminal lock 201 is located above the notch or groove 110 and spaced apart from the lower housing of the first housing section. When inserting the terminal 300 into the terminal receiving inner passageway 103, the terminal 300 presses the terminal blocking member 105 and the terminal lock 201 there below to enable them to be biased towards inside of the notch or groove 110 so that the terminal 300 enters the terminal receiving inner passageway 103.

As shown in FIG. 5 and FIG. 6, when the TPA article 200 is located at the pre-locked position, the terminal lock 201 abuts against a lower surface of the terminal blocking member 105. At this time, the TPA article 200 is entirely received in the housing 100, with the TPA article 200 being received in the housing 100, without exposure when at the pre-locked position as comparing the connector according to the present invention with the connector in the prior art as shown in FIG. 1, in the case that they have housings of the same size.

As shown in FIGS. 3A-3C and FIGS. 4A-4B, the second housing section on the TPA article 200 has positioning ribs 202 extending forward from the inner bottom surface and the lower housing of the first housing section on the housing 100 has receiving slots 111 for receiving the positioning ribs 202. When starting to assemble the TPA article 200 with the housing 100 cooperatively, the housing 100 and the TPA article 200 are cooperatively pre-positioned first by the positioning ribs 202 and the receiving slots 111.

Figure 8:
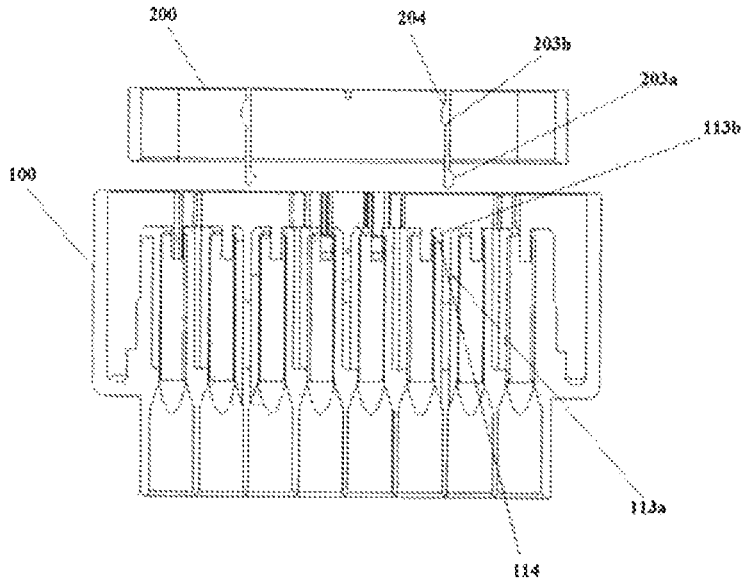
FIG. 8 is another sectional view of the connector according to the present invention before assembly.
Figure 9:
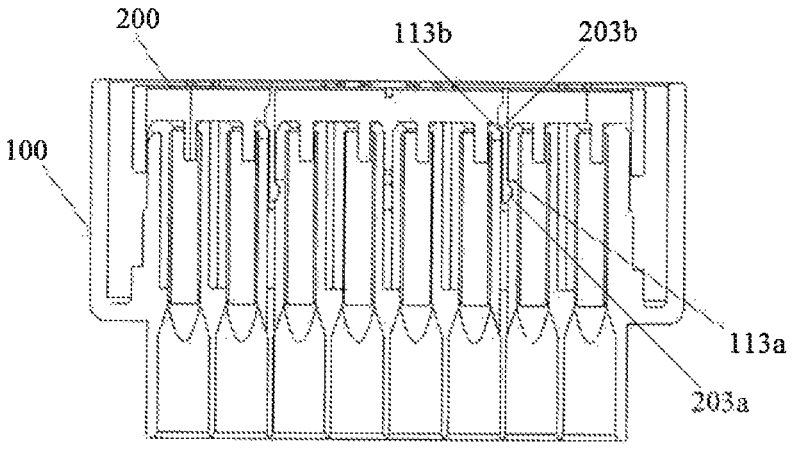
FIG. 9 is a sectional view of the connector in FIG. 8 in a pre-locked state.
Figure 10:
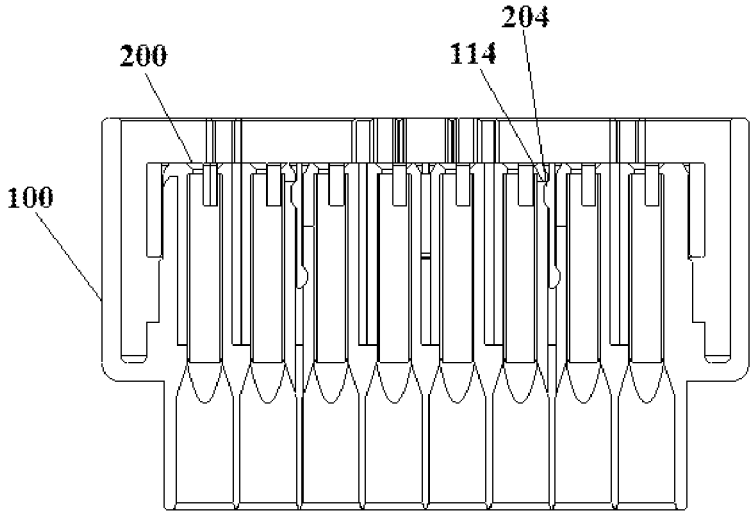
FIG. 10 is a sectional view of the connector in FIG. 8 in a locked state.

As shown in FIGS. 4A-4B and FIGS. 8, 9, and 10, a vertical connection plate 205 is provided between upper and lower housings of the second housing section on the TPA article 200. A pair of connection plates 205 is shown in FIG. 4A and FIG. 4B. The vertical connection plate 205 has a main body portion 206 located within the upper and lower housings and a raised portion 207 extending forward from a front end of the main body portion 206. In the example shown in the figures, the raised portion 207 extends forward and protrudes out of the second housing section. A first pre-locking protrusion 203*a* is provided on a front end face of the raised portion 207 of the vertical connection plate 205 and a second pre-locking protrusion 203*b* is provided at a center of a surface of the main body portion 206 of the vertical connection plate 205. The first housing section is provided with mating structures which correspond to the first and second pre-locking protrusions 203*a*, 203*b*, respectively, and includes a first pre-locking receiving passageway 113*a* and a second pre-locking stopper 113*b*, as shown in FIGS. 8, 9, and 10. As shown in FIG. 9, after the first and second pre-locking protrusions 203*a*, 203*b* mate with the first pre-locking receiving passageway 113*a* and the second pre-locking stopper 113*b*, the TPA article 200 can be fixedly held at the pre-locked position relative to the housing 100.

A final locking protrusion 204 is provided at a center of the surface of the main body portion 206 of the vertical connection plate 205. In the example shown in FIG. 8, the final-locked protrusion 204 is connected integrate with the second pre-locking protrusion 203*b* on the vertical connection plate 205 to form a raised portion; the second pre-locking protrusion 203*b* and final locking protrusion 204 are located on a front side and a rear side of the raised portion respectively. Further referring to FIG. 8, the first housing section is provided with a final locking stopper 114 mating with the final locking protrusion 204. As shown in FIG. 10, after the final locking protrusion 204 of the vertical connection plate 205 mates with the final locking stopper 114 on the first housing section, the TPA article 200 can be held at the locked position relative to the housing 100.

The number of the positioning ribs 202 and vertical connection plates 205 as described above is not limited here and can be set according to the width and strength of the second housing section in specific implementation.

In a specific embodiment of the present invention, the connector further includes a terminal 300. In the example shown in FIG. 6, the terminal 300 includes a contact portion 301 and a wiring portion 303. The contact portion 301 is provided with a snapping slot 305 configured to mate with the rear perpendicular locking surface 107 on the terminal blocking member 105 to stop the terminal 300 from retreating from the connector housing 100.

When the connector is located at the pre-locked state (i.e., the TPA article 200 is located at the pre-locked position), the terminal 300 can be inserted into the terminal receiving inner passageway 103 towards the tail portion 104 from the front end of the terminal receiving portion 102. During insertion, the contact portion 301 of the terminal 300 presses against the terminal blocking member 105 so that the terminal blocking member 105 curves downward and meanwhile presses the terminal lock 201 to curve towards inside of the notch or groove 110. After an end of the contact portion 301 of the terminal 300 passes over the front inclined guide surface 106 of the terminal blocking member 105, the front end of the terminal 300 is blocked by a terminal stopper 112 (as shown in FIG. 3C) disposed on the housing 100 and cannot continue being inserted. At this time, the terminal 300 is limited by the rear perpendicular locking surface 107 and cannot retreat from the housing 100, i.e., it moves forward and is arranged in the insertion direction at a desired position after assembly. At this time, the terminal blocking member 105 and the terminal lock 201 rebound to the original positions and the rear perpendicular locking surface 107 on the terminal blocking member 105 mates with the retreat-stopping structure on the terminal 300 to stop the terminal from retreating. Thereafter, the TPA article 200 is pushed to move forward so that the terminal lock 201 is inserted into the locking slot 109 to enable the terminal lock 201 and terminal blocking member 105 to tightly mate with the inner bottom surface 108 of the first housing section. As such, the terminal blocking member 105 and the terminal lock 201 do not curve any more so that the terminal 300 is firmly locked in the connector (namely, the TPA article 200 is located at the locked position).

Since the TPA article 200 can be entirely received in the housing 100 when at the pre-locked position, the products of the connector according to the present invention can be packaged in a manner such as in a laminated and pressed manner so that the packaging and transport costs can be reduced.

The positional or directional terms "front" and "rear" mentioned in the text are relative to an insertion direction of the terminal, and the insertion direction of the terminal is defined as insertion into the connector from front to rear.

Although the present invention is described with reference to the specific embodiments shown in the figures, it should be appreciated that without departing from the spirit and scope taught by the present invention, many variations may be made to the connector housing and connector according to the present invention. Various parts in different specific embodiments of the present invention can be interchanged or recombined without departing from the spirit and invention taught by the present invention, and the resultant connector housings and connectors fall within the protection scope of the present invention. Those of ordinary skilled in the art will further appreciate that different manners for changing parameters, such as dimension, shape, or types of elements or materials, of the disclosed embodiments all fall within the spirit and scope of the present invention and claims.

What is claimed is:

1. A connector, comprising:

a housing having a body and a terminal receiving portion extending rearward from the body, the terminal receiving portion having a tail portion that has a periphery forming a first housing section including a lower housing having a notch or groove extending continuously from a rear end thereof; and a terminal position assurance article wholly received into a rear end of the housing and corresponding with the terminal receiving portion, the terminal position assurance article having a terminal lock, a front end of the terminal lock located above the notch or groove when the terminal position assurance article is positioned in the housing.

2. The connector according to claim 1, wherein the terminal position assurance article has a second housing section adapted for connection with the first housing section.

3. The connector according to claim 2, wherein the terminal receiving portion has a terminal receiving inner passageway and a terminal blocking member positioned in the terminal receiving inner passageway.

4. The connector according to claim 3, further comprising a locking slot disposed between the terminal blocking member and an inner bottom surface of the first housing section receiving the terminal lock.

5. The connector according to claim 4, wherein a rearward extension length of the inner bottom surface of the first housing section is less than a rearward extension length of the terminal blocking member.

6. The connector according to claim 3, wherein a front end of the notch or groove is positioned below a rear end of the terminal blocking member.

7. The connector according to claim 6, wherein the front end of the terminal lock abuts against an undersurface of the terminal blocking member when the terminal position assurance article is positioned in the housing.

8. The connector according to claim 3, wherein the terminal blocking member has a front inclined guide surface and a rear perpendicular locking surface.

9. The connector according to claim 2, further comprising positioning ribs extending forward from the inner bottom surface of the second housing section and receiving slots positioned along the inner bottom surface of the first housing section receiving the positioning ribs.

10. The connector according to claim 1, wherein the terminal lock has a plurality of elastic cantilever structures spaced apart from one another.

11. The connector according to claim 1, further comprising a terminal, wherein the terminal receiving portion has a terminal receiving inner passageway for receiving the terminal, and wherein the terminal is locked and fixed in the housing when the terminal position assurance is located at a locked position.

12. A connector, comprising:

a housing having a body and a terminal receiving portion extending rearward from the body, the terminal receiving portion having a tail portion with a periphery that forms a first housing section; and a terminal position assurance article wholly received into a rear end of the housing and corresponding with the terminal receiving portion, the terminal position assurance article having a second housing section adapted for connection with the first housing section and a vertical connection plate disposed between upper and lower housings of the second housing section, the vertical connection plate having a main body portion located within the upper and lower housings and a raised portion extending forward from a center of a front end of the main body portion and out of the upper and lower housings.

13. The connector according to claim 12, wherein the vertical connection plate has a first pre-locking protrusion and a second pre-locking protrusion on a front end face of the raised portion of the vertical connection plate.

14. The connector according to claim 13, wherein the first housing section has a pre-locking receiving passageway and a second pre-locking stopper corresponding with the first and second pre-locking protrusions, respectively.

15. The connector according to claim 12, wherein the vertical connection plate has a final locking protrusion provided at a center of a surface of the main body portion.

16. The connector according to claim 15, wherein the first housing section of the tail portion has a final locking stopper receiving the final locking protrusion thereon.

17. The connector according to claim 12, wherein the terminal receiving portion has a tail portion, which has a periphery forming a first housing section including a lower housing having a notch or groove extending continuously from a rear end thereof.

18. The connector according to claim 17, wherein the terminal position assurance article has a terminal lock, a front end of the terminal lock located above the notch or groove when the terminal position assurance article is positioned in the housing.

19. The connector according to claim 12, wherein the terminal lock has a plurality of elastic cantilever structures spaced apart from one another.

20. The connector according to claim 12, further comprising a terminal, wherein the terminal receiving portion has a terminal receiving inner passageway for receiving the terminal, and wherein the terminal is locked and fixed in the housing when the terminal position assurance is located at a locked position.

* * * * *